US006394386B1

(12) United States Patent
Lo

(10) Patent No.: US 6,394,386 B1
(45) Date of Patent: May 28, 2002

(54) PAPER REEL FOR YARN PACKAGES

(76) Inventor: Yueh-O Lo, No. 6, Lane 23, Kung Wuu Road Wu Lin Tsuen Long-Tarn Shiang, Taoyan (TW)

( * ) Notice: Subject to any disclaimer, the term of this patent is extended or adjusted under 35 U.S.C. 154(b) by 0 days.

(21) Appl. No.: 09/657,590

(22) Filed: Sep. 8, 2000

(51) Int. Cl.[7] ..... B65H 75/18; B65H 75/10

(52) U.S. Cl. ..... 242/610.3; 242/118.31; 242/610.1; 242/613.4; 242/613.5; 493/954

(58) Field of Search ..... 242/610.3, 610.1, 242/610, 613.4, 613.5, 118.3, 118.31, 118.32; 493/954

(56) References Cited

U.S. PATENT DOCUMENTS 2,288,966 A * 7/1942 Blanchet ..... 242/118.31
3,224,696 A * 12/1965 Hendry, Jr. ..... 242/118.31 X
3,675,871 A * 7/1972 Heyden ..... 242/118.3
3,990,649 A * 11/1976 Adams ..... 242/118.32
4,742,972 A * 5/1988 Rost et al. ..... 242/118.31
4,949,913 A * 8/1990 Fernandez ..... 242/118.3
5,056,733 A * 10/1991 Segars et al. ..... 242/118.32
5,403,633 A * 4/1995 Jenisch ..... 242/118.3 X

* cited by examiner

*Primary Examiner*—Michael R. Mansen
*Assistant Examiner*—Minh-Chau Pham
(74) *Attorney, Agent, or Firm*—Bacon & Thomas

(57) ABSTRACT

A paper reel for yarn packages, and especially a paper reel of which the upper end is cut into a ladder like multiple layered end, the cut wall is folded inwardly twice, so that the end of the paper reel is folded onto a shoulder of the ladder like cut and is fixed, and the end of the paper reel will not warp nor has a paper rough edge. Both ends of the paper reel are processed to form a round shape, the ladder like portion has cut wall portions on its shoulders; the cut wall portions are folded to the shoulders one by one, the thickness formed by the cut wall portions folded back to the shoulders can afford a larger pressure when the paper reel is subjected to an axial force, thereby, the cut wall portions will not warp. The inner surface of the paper reel thereby is a smooth surface to be smoothly slipped over a rotation axle, yarn on the paper reel can thus be uninterruptedly sent out for weaving.

1 Claim, 7 Drawing Sheets

PAPER REEL FOR YARN PACKAGES

BACKGROUND OF THE INVENTION

1. Field of the Invention

The present invention is related to an improved structure of paper reel for yarn packages, and especially to a paper reel of which the upper end is cut into a ladder like multiple layered end, the cut wall is folded inwardly twice, so that the end of the paper reel is folded into the area where the cut locates and is fixed. The end of the paper reel thus is held in the cut, so that the end of the paper reel will not warp nor has a paper rough edge, then the paper reel for yarn packages can be smoothly slipped over a rotation axle to do yarn reeling. And the area with the cut on the paper reel still gets a thick wall, so that the paper reel is not subjected to deformation under heavy pressure during moving.

2. Description of the Prior Art

Paper reels used for ordinary yarn are all made from a plurality of overlapping synthetic papers which have beveled edges to be rolled helically, then the tailing ends of the papers are stuck with glue to get a fixed state. However, in using a paper reel, the end of the paper reel often warps; thereby, during weaving, yarn may be tangled by the reel end, and is subjected to breaking. The weaving operation must be stopped temporarily by cutting the machine, and can only continue to operate after connecting the breaking yarn. The yarn breaking most often occurs when yarn on the paper reel is to be exhausted, and some operator will discard the yarn with the paper reel when the yarn is to be exhausted. This results waste of resources, and is uneconomic for it will be quite a large number after a period of time.

A U.S. Pat. No. 3,990,649 (referring to FIG. 1 and 2) has an end 38 of a paper reel 30 cut into a shape of "L" then the cut wall is folded inwardly to make the end of the paper reel 30 be folded into the area where the cut locates. However, after folding of the cut wall of the patent, it is not fixed onto the inner wall of the paper reel 30, and a very large gap "A" is left between the cut wall and the inner wall of the paper reel 30 (this is not marked in the original drawing, we hereby mark the gap with "A" for clarity). Thereby, when the paper reel 30 is inserted in a weaving machine, the cut wall may contact the structure of the machine; when the paper reel 30 is drawn out of the machine, the cut wall is subjected to creating a rough edge. Thereafter, the paper reel 30 will be uneasy to be inserted and slipped over a rotation axle by interruption of the rough edge of paper, thus the weaving work is badly influenced. The patent got rid of the defect of warping of the synthetic papers at the end of the paper reel by folding inwardly of the cut wall, nevertheless, it further creates inconvenience when in contact with the machine, and leaves a trouble to manufacturers.

The paper reel of the above stated patent has the end thereof cut to more than ½ to ⅔ thickness thereof, a notch is formed, and the remaining wall thickness is very thin, strength of the notch thus is largely reduced. Therefore, even after folding, the notch with insufficient strength (as shown by d1 in FIG. 1) under an external heavy weight will simultaneously raise the reel wall inwardly and outwardly, putting out of the yarn of the paper reel is influenced, this is a defect of designing in overly cutting the end of the paper reel. Furthermore, if the wall thickness at the notch is less cut, the cut wall is not easy to fold, and deformation may occur on the inner and outer walls of the paper reel during folding. Manufacturers have had headaches in bothering about this.

SUMMARY OF THE INVENTION

In view of this, the inventor of the present invention considers that a paper reel for a yarn is the best tool for winding the yarn, by making the pipe mouth of the paper reel rounded, and then having the end of the paper reel cut into a ladder like notch, and the cut wall is folded inwardly twice, so that the end of the paper reel is folded into the area where the cut locates and is fixed. In this way, the end of the paper reel will no more warp, and no rough edge will be induced.

The primary object of the present invention is to cut the end of the paper reel into a ladder like notch, and fold the cut wall inwardly twice, so that the end of the paper reel is folded into the area where the cut locates and is fixed. Thereby, the end of the paper reel will be more secure; no warping and no rough edge will be induced.

Another object of the present invention is to provide a ladder like cut on the end of the paper reel, the wall at the lower portion of the notch formed by cutting has a larger thickness, so that the paper reel can afford larger pressure.

Another object of the present invention is to provide a ladder like notch on the end of the paper reel; and after folding the cut wall, the notch gets a sufficient thickness to have larger strength.

A further object of the present invention is to fix the end of the folding portion of the paper reel after twice folding to the wall at the lower portion of the notch such as by sticking with adhesive, so that the end of the folding portion is more secure rather than subjected to releasing or warping.

The present invention will be apparent in its particular structure and characteristics after reading the detailed description of the preferred embodiment thereof in reference to the accompanying drawings.

DETAILED DESCRIPTION OF THE PREFERRED EMBODIMENT

Figure 2:
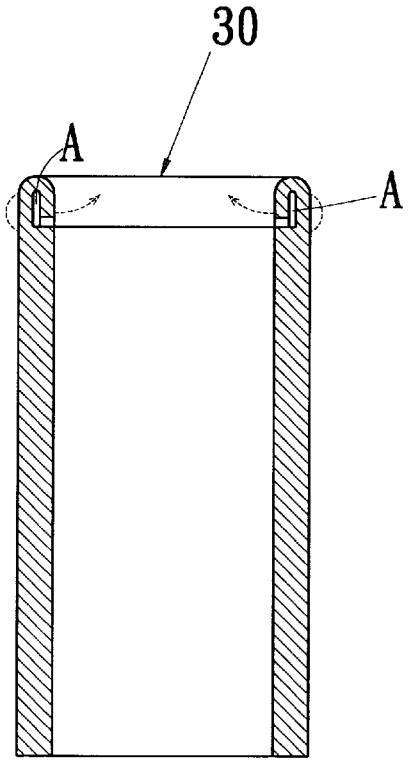
PRIOR ART FIG. 2
FIG. 2 is a sectional view of the U.S. Pat. No. 3,990,649 after folding of the end thereof.
Figure 1:
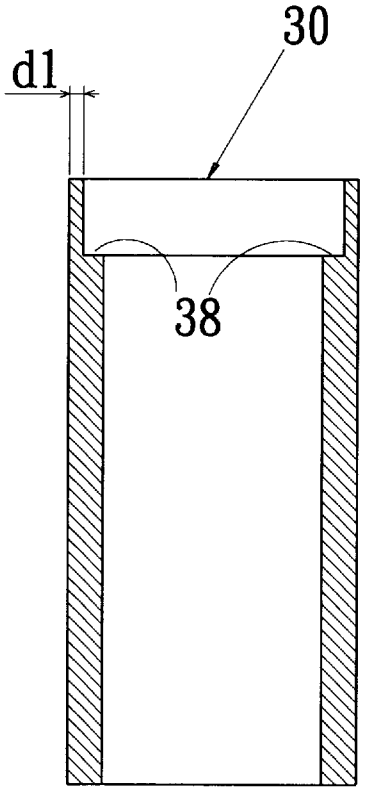
PRIOR ART FIG. 1
FIG. 1 is a sectional view of a U.S. Pat. No. 3,990,649.
Figure 3:
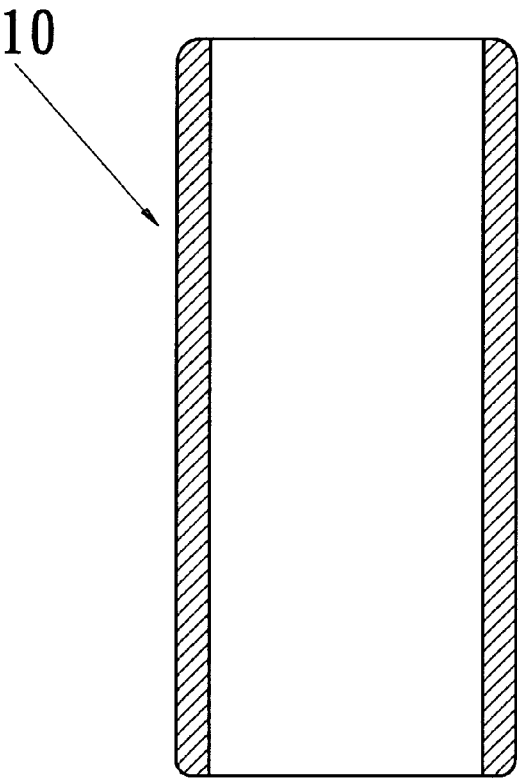
FIG. 3 is a sectional view showing the structure of the paper reel of the present invention of which both the ends are processed tone round.
Figure 5:
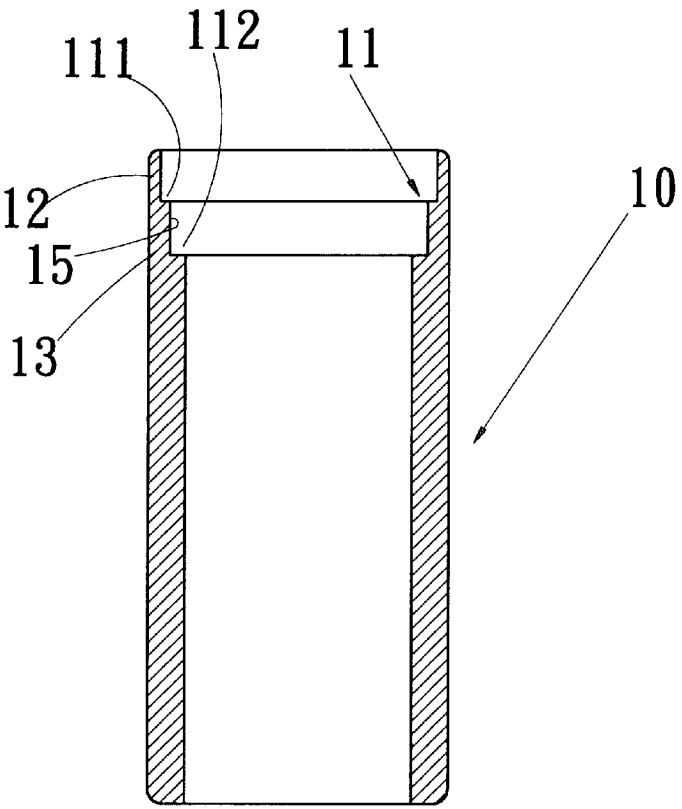
FIG. 5 is sectional view showing the structure of the paper reel of the present invention after cutting of the upper end thereof.
Figure 4:
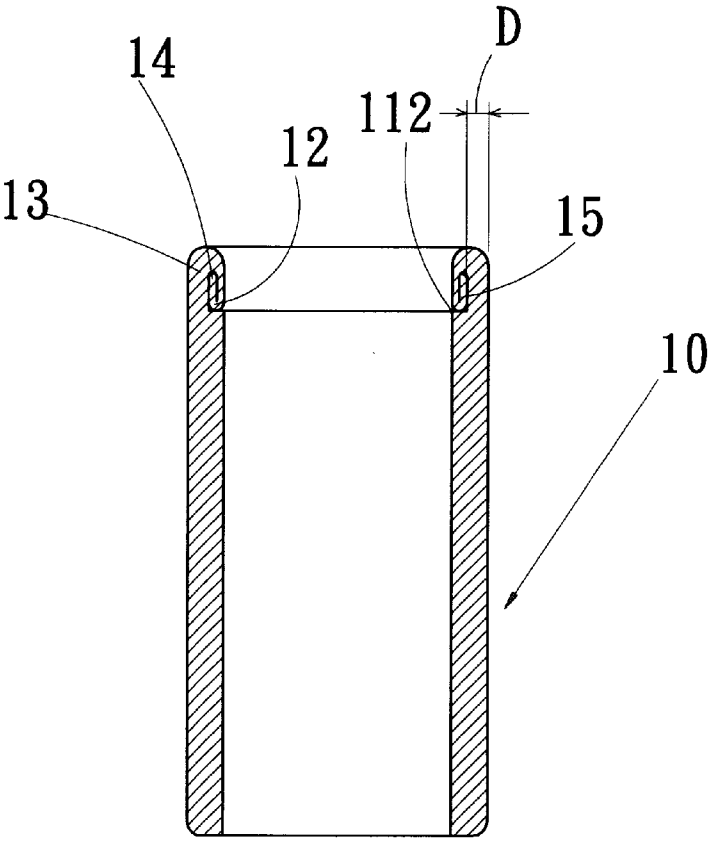
FIG. 4 is sectional view showing the structure of the paper reel of the present invention with the upper end thereof folded.
Figure 6:
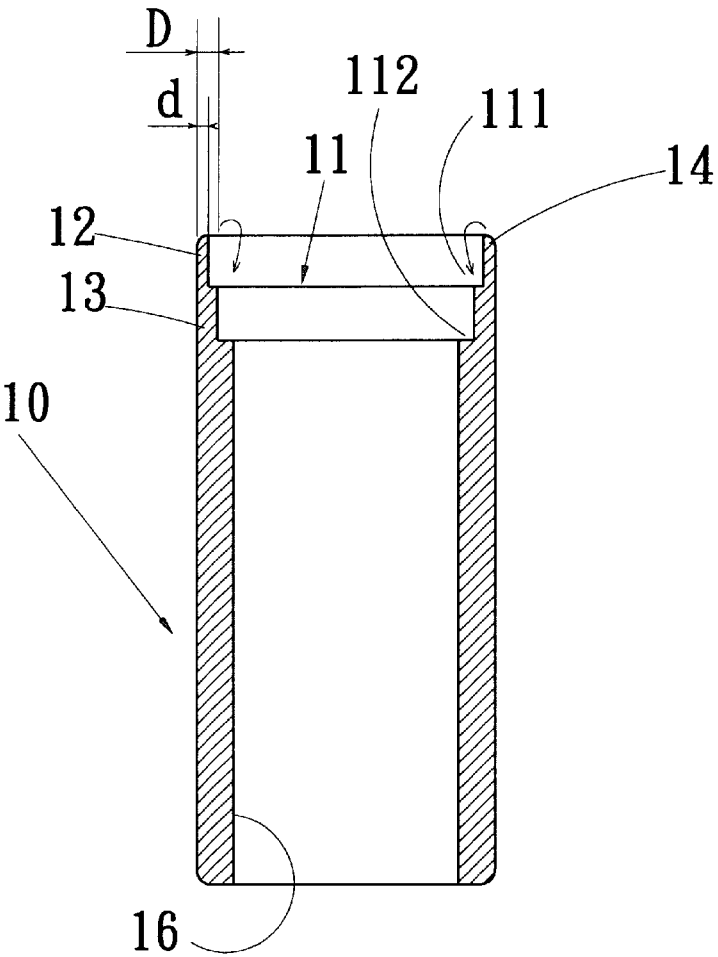
FIG. 6 is sectional view showing the way of the first time folding of the upper end of the paper reel of the present invention.

Referring firstly to FIGS. 3 and 4, after producing and shaping of a paper reel 10 of the present invention, both the two ends of the paper reel 10 are processed to form a round shape, and the upper end is cut interiorly to form a ladder like notch 11 (as shown in FIGS. 5 and 6). The notch 11 has a first shoulder 111 and a second shoulder 112 provided for folding of the cut upper end; a first cut wall portion 12 is left on the first shoulder 111, and a second cut wall portion 13 is left on the second shoulder 112. The inner surface of the second cut wall portion 13 and the external surface of the paper reel 10 make a thickness "D", so that the second cut wall portion 13 having the thickness "D" can afford a larger pressure when the paper reel 10 is subjected to an axial force. The second cut wall portion 13 is not subjected to bending or deformation and thus increases the strength of the paper reel 10 in bearing weight.

Figure 7:
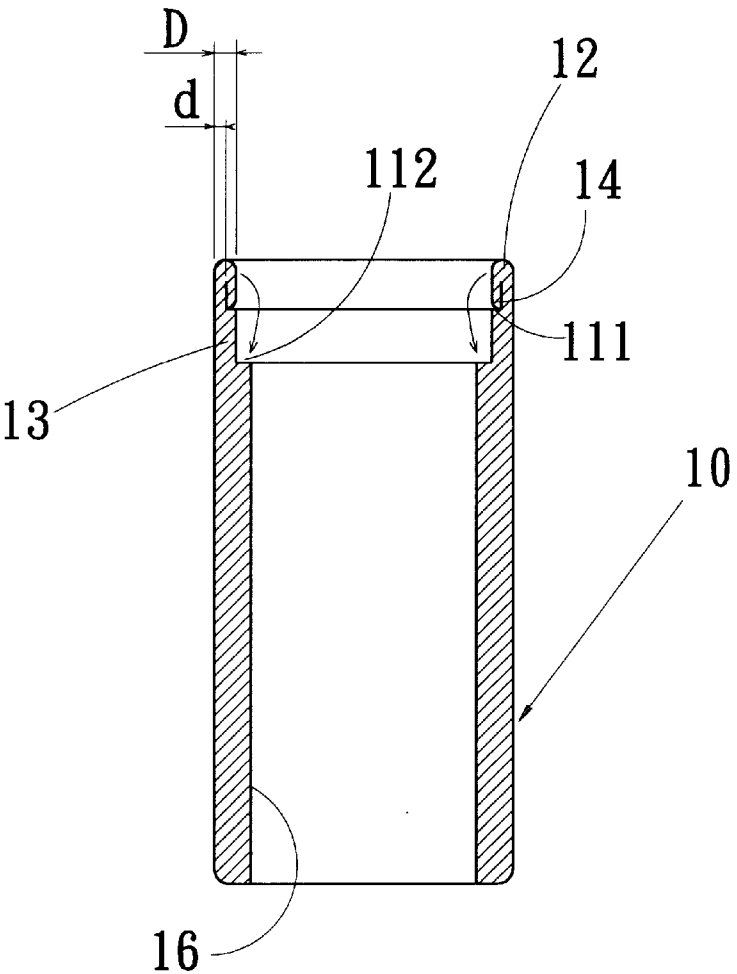
FIG. 7 is sectional view showing the way of the second time folding of the upper end of the paper reel of the present invention.
Figure 8:
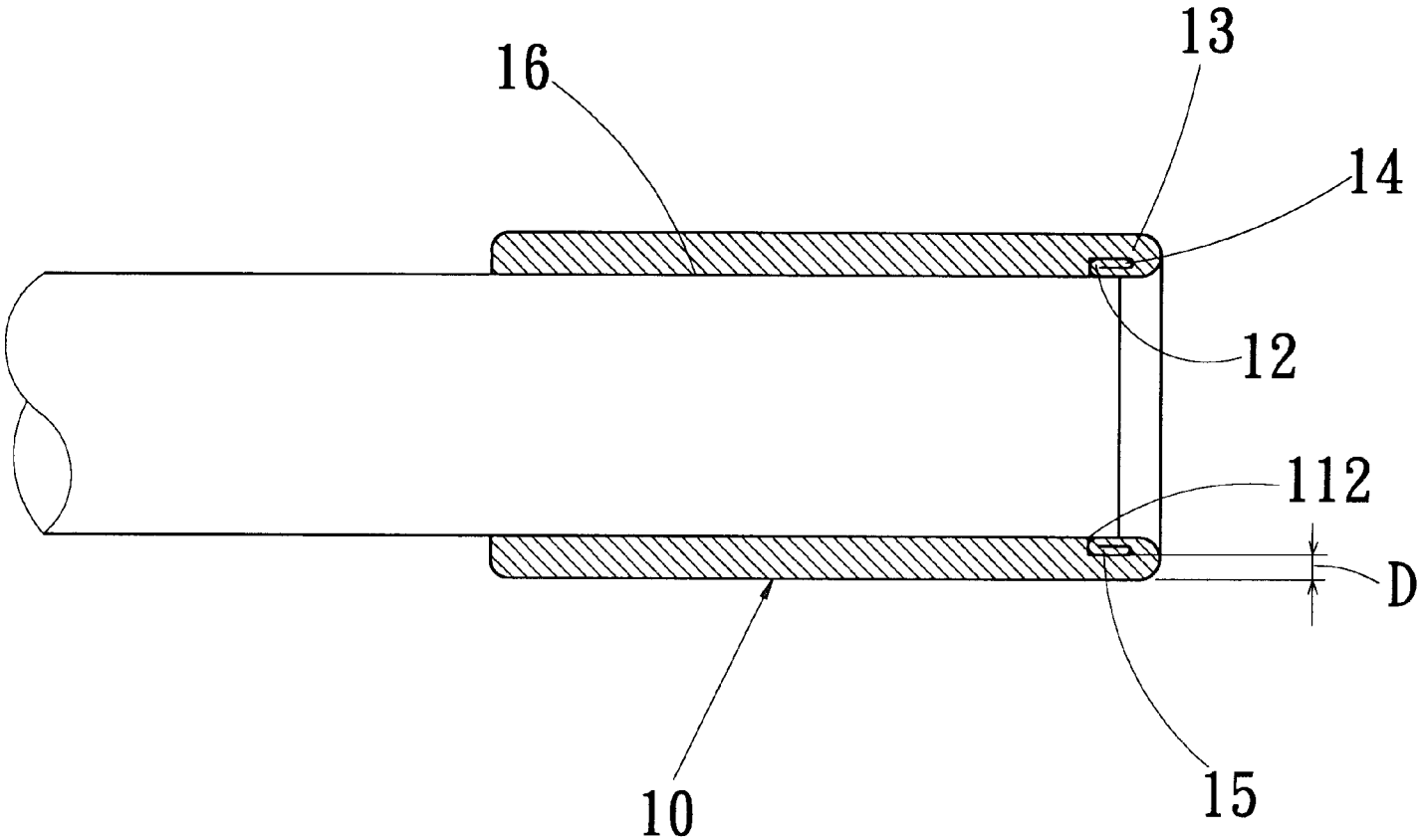
FIG. 8 is sectional view showing the paper reel of the present invention being slipped over a rotation axle.

As shown in FIG. 7, the steps to form the cut wall of the paper reel 10 are as follows, the first cut wall portion 12 having a thickness "d", is folded to the first shoulder 111 so that the thickness formed by the first cut wall portion 12 folded onto itself is doubled or 2*d* which exactly equals the thickness "D" of the second cut wall portion 13. Then the first cut wall portion 12 and the second cut wall portion 13 are simultaneously folded onto the second shoulder 112. Now the tailing end 14 of the first cut wall portion 12 gets close to the inner surface 15 of the second cut wall portion 13 and is fixed thereto, thereby, neither the first cut wall portion 12 nor the second cut wall portion 13 warp. The inner surface 16 of the paper reel 10 thereby is a smooth surface, when the paper reel 10 is placed onto a weaving machine (as shown in FIG. 8), neither warping nor rough edge will be induced on the inner surface 16 of the paper reel 10.

Figure 9:
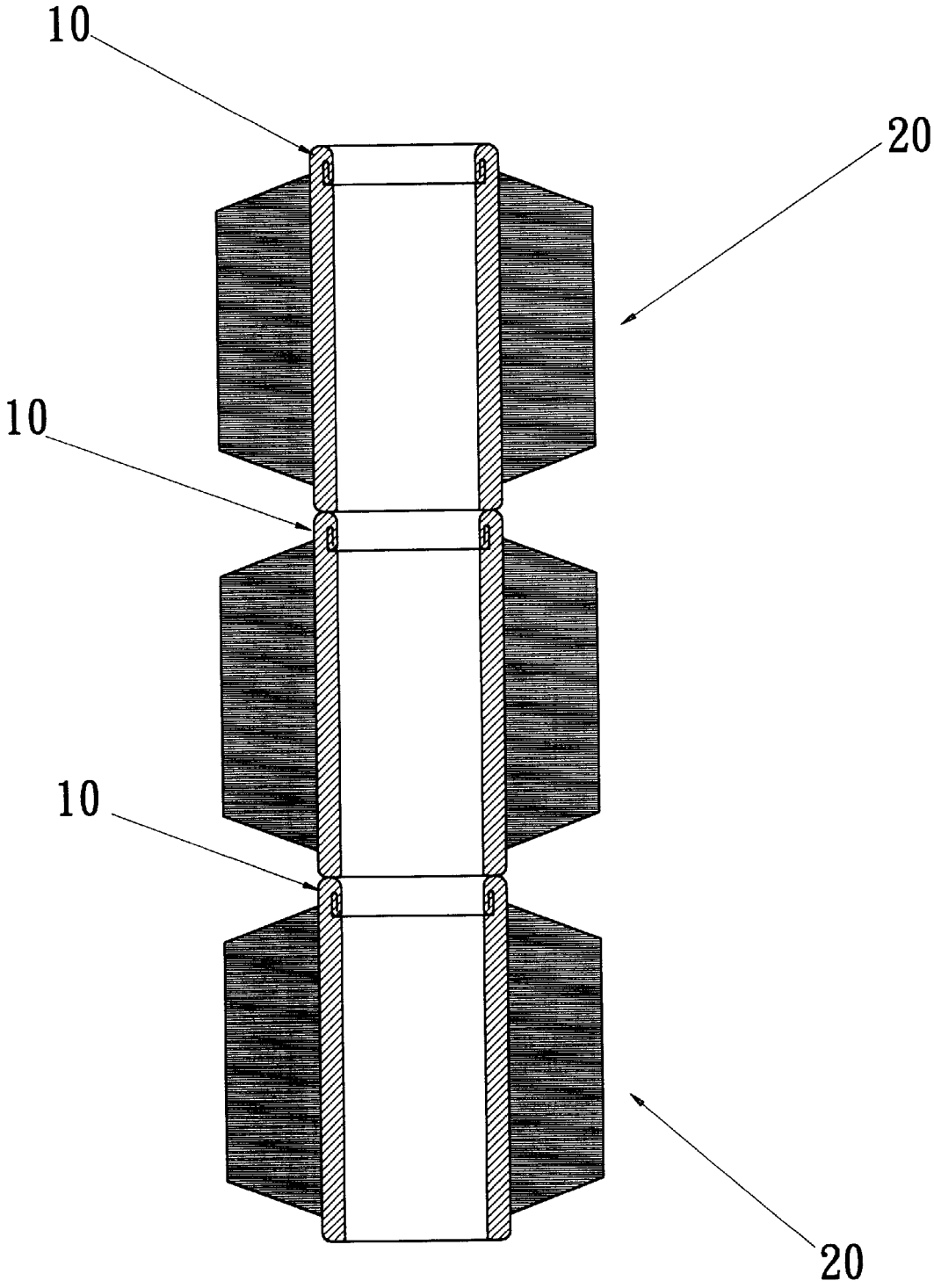
FIG. 9 is schematic sectional view showing use the paper reel of the present invention for yarns.
Figure 10:
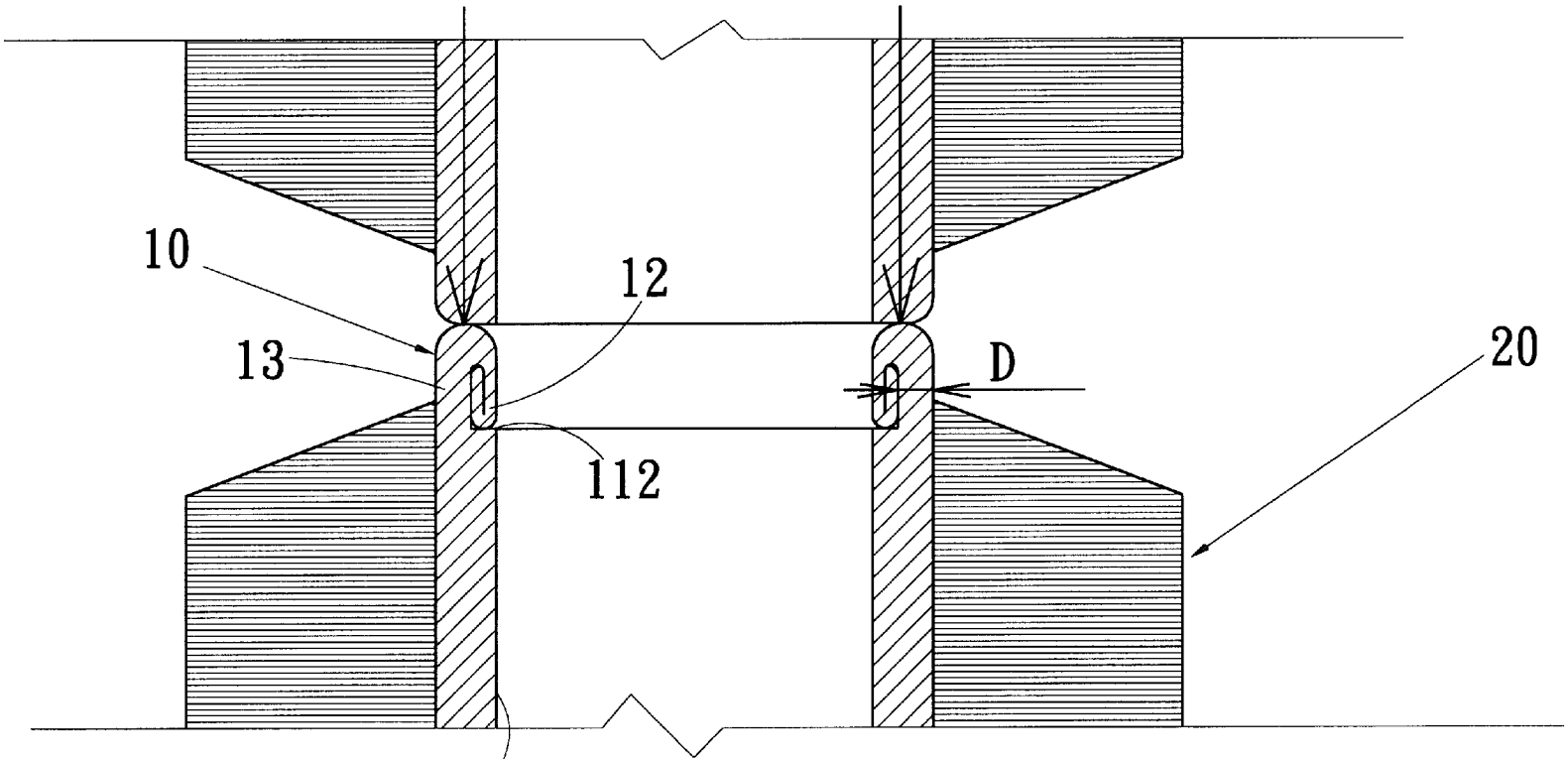
FIG. 10 is schematic sectional view showing a partially enlarged portion of the present invention.

After the paper reel 10 is formed by folding, the second cut wall portion 13 has a larger thickness "D", this can increase the axial bearing capacity of the paper reel 10 and thus can prevent the surfaces of the paper reel 10 from raising and deformation laterally. The completed paper reel 10 is used to wrap thereon yarn (as shown in FIGS. 9 and 10) to form a reel with yarn 20 which is much heavier; when the reel with yarn 20 is moved, mostly it is stacked over some other reels with yarns 20 in order to reduce occupying space of the individual reel with yarn 20. However, reels with yarns 20 stacking one over another also bear, in addition to their own weight, the weight of other upper reels with yarns 20. The lower ones bear the weight of other upper reels with yarns 20, as to the weight born, the lower the larger.

The weight exerting on a reel with yarn 20 is born by the two ends thereof; wherein, one end of the paper reel 10 has been processed by folding. Such end in the present invention are folded twice to form a multiple layers, the first cut wall portion 12 and the second cut wall portion 13 are simultaneously folded onto the second shoulder 112 to make a round tailing end on the cut wall of the paper reel 10, wherein, the second cut wall portion 13 is left with a larger thickness "D". In this way, although the paper reel 10 has its end folded, when in bearing weight, the wall of the end can be prevented from raising or deformation. So that the yarn on the reel of yarn 20 can be completely and smoothly sent out when in use, rather than is influenced by a raising or rough edge of the paper reel 10, possibility of yarn breaking is largely reduced. The yarn can be smoothly sent out of the paper reel 10 all the way to the final end of the yarn.

Having thus described my invention, what I claim as new and desire to be secured by Letters Patent of the United States are:

1. An improved structure of paper reel for yarn packages, said paper reel having an upper end wherein the upper end of said paper reel is processed to form a round shape, and said upper end is cut interiorly to form a ladder like notch, said notch has a first shoulder and a second shoulder provided for folding of said cut upper end; a first cut wall portion having a tailing end is left on said first shoulder, and a second cut wall portion having an inner surface is left on said second shoulder; said first cut wall portion is folded to said first shoulder, the thickness formed by said first cut wall portion folded onto itself exactly equals to the thickness of said second cut wall portion, then said first cut wall portion and said second cut wall portion are simultaneously folded onto said second shoulder, the tailing end of said first cut wall portion thus gets close to the inner surface of said second cut wall portion and is fixed thereto, thereby, neither said first cut wall portion nor said second cut wall portion warps.

* * * * *